US006308484B1

(12) United States Patent
Severino

(10) Patent No.: US 6,308,484 B1
(45) Date of Patent: Oct. 30, 2001

(54) INSULATED CONCRETE FORMING SYSTEM

(75) Inventor: Charles J. Severino, Holmes, NY (US)

(73) Assignee: Thermalite, Inc., Carmel, NY (US)

( * ) Notice: Subject to any disclaimer, the term of this patent is extended or adjusted under 35 U.S.C. 154(b) by 0 days.

(21) Appl. No.: 09/368,747

(22) Filed: Aug. 5, 1999

(51) Int. Cl.[7] ..... E04B 2/86; E04G 17/06
(52) U.S. Cl. ..... 52/426; 249/216
(58) Field of Search ..... 52/562, 568, 565, 52/426, 442; 249/38, 40, 44, 45, 47, 216

(56) References Cited

U.S. PATENT DOCUMENTS

| | | | |
|---|---|---|---|
| 1,924,724 | 8/1933 | Olney . | |
| 3,788,020 | 1/1974 | Gregori . | |
| 3,985,329 | 10/1976 | Liedgens . | |
| 4,655,014 | 4/1987 | Krecke . | |
| 4,706,429 | 11/1987 | Young . | |
| 4,730,422 | 3/1988 | Young . | |
| 4,765,109 | 8/1988 | Boeshart . | |
| 5,065,561 | 11/1991 | Mason . | |
| 5,896,714 * | 4/1999 | Cymbala et al. | 52/426 |

* cited by examiner

*Primary Examiner*—Michael Safavi

(74) *Attorney, Agent, or Firm*—Handal & Morofsky

(57) ABSTRACT

A device for interlocking form panels. It contemplates an elongated member having first and second sections that are substantially planar and have first and second ends and first and second sides. First and second flange members are attached to the ends and diverge from the elongated member. These flange members are also substantially planar, parallel to each other and protrude perpendicularly out of the plane of the elongated member an equal distance from the first and second sides of the elongated member. A first pair of guide rib members is attached to the elongated member at a point near the first end of the elongated member, is in a parallel planar relationship with the first diverging flange member, and protrudes perpendicularly from the first side of the elongated member. This first pair of guide rib members is attached at a point from the first diverging flange member so as to define a distance that is substantially equal to the thickness of a form panel. A second pair of guide rib members is attached to the elongated member at a point near the second end of the elongated member, is in a parallel planar relationship with the second diverging flange member, and protrudes perpendicularly from the second side of the elongated member. This second pair of guide rib members is attached at a point from the second diverging flange member so as to define a distance that is substantially equal to the thickness of a form panel. Frangible bridges for separating the first section of the tie from the second section of the tie are perpendicularly situated along the longitudinal axis of the tie from the first end to the second end.

12 Claims, 8 Drawing Sheets

INSULATED CONCRETE FORMING SYSTEM

BACKGROUND OF THE INVENTION

1. Field of the Invention

The present invention relates to a an insulated concrete forming system, more particularly to a system of supports that maintains forms in a desired spacial relationship between which concrete is poured.

2. Description of Related Art Including Information Disclosed Under 37 CFR 1.97 and 37 CFR 1.98.

Typical wall-forming systems employ "blocks", which work as a pair of panels spaced apart by a system of "ties" and are stacked to form a wall of the desired height. The panels can be made of wood or some other material. More effective systems utilize panels of lighter weight materials such as polystyrene. The ties which hold the panels in the predetermined spatial relationship have typically been dowels of fixed length inserted from the outside of the panels through the form and perpendicular to the plane of the panels. These dowels have usually been expensive steel rods which are costly to transport. In an effort to reduce the cost of transportation such ties have been manufactured from lightweight plastics. However, such plastic ties, while they do address certain cost issues, are not without problems.

Another problem with the plastic tie of the prior art is that ties placed at the top and/or bottom of the form protrude above or below the form and, have to be cut. Alternatively, no ties may be used or a half tie could be placed at the top or bottom of the form, thus eliminating the need for cutting any tie at the top of the form. However this involves manufacture transport and stocking of the ties. The absence of ties at the top and bottom of the form, however, results in structural instability and reduced strength of the form and can pose a safety threat to workers while concrete is being poured.

A further problem with the ties of the prior art is that they are flimsy and composed of two or more parts. Ties which are very narrow and thin do not lend much to the structural integrity of the concrete form, and ties which are composed of a plurality of pieces may separate and weaken the form while concrete is being poured into it.

It is therefore a general object of the present invention to provide an improved tie of a single length and height which can be used to form panel walls of varying heights, while providing for the strength and stability of forms stabilized by top and bottom tie without the need for specialized top and bottom ties or foam panels with dedicated middle or top and bottom elements.

It is also an object of the present invention to provide a tie which can be used to hold the uppermost and bottommost portions of the panels together in order to maintain the structural integrity of the form while concrete is being poured into it It is a further object of the invention to provide a tie formed from a single piece of plastic to eliminate the chance of a tie separating while it is being subjected to the stresses of concrete being poured into the form.

SUMMARY OF THE INVENTION

The present invention is drawn to a device for interlocking form panels. It contemplates an elongated member that is substantially planar and having first and second sections connected by frangible bridges. First and second sections each have first and second ends. First and second flange members are attached to the ends and diverge from the elongated member. These flange members are also substantially planar, parallel to each other and protrude perpendicularly out of the plane of the elongated member an equal distance from the first and second sides of the elongated member.

A first pair of guide rib members is attached to the elongated member at a point near the first end of the elongated member, is in a parallel planar relationship with the first diverging flange member, and protrudes perpendicularly from the first side of the elongated member. This first pair of guide rib members is attached at a point from the first diverging flange member so as to define a distance that is substantially equal to the thickness of a form panel.

A second pair of guide rib members is attached to the elongated member at a point near the second end of the elongated member, is in a parallel planar relationship with the second diverging flange member, and protrudes perpendicularly from the second side of the elongated member. This pair of guide rib members is attached at a point from the second diverging flange member so as to define a distance that is substantially equal to the thickness of a form panel.

A frangible bridge separates the top half of the elongated member from the bottom half of the elongated member and is positioned along the longitudinal axis of the elongated member. The top half of the elongated member is coplanar with the bottom half of the elongated member.

Another embodiment of the tie contemplates a third pair of guide rib members protruding perpendicularly out of the second side of the elongated member and configured, positioned, and dimensioned so as to be in a parallel planar relationship with the first pair of diverging flange members and to define a distance between the first pair of diverging flange members and the third pair of guide rib members that is equal to the thickness of a form panel. This embodiment also contemplates a fourth pair of guide rib members protruding perpendicularly out of the first side of the elongated member at points equal and distal from the second pair of diverging flange members and being configured, positioned, and dimensioned so as to be in a parallel planar relationship with the second pair of diverging flange members and to define a distance between the second pair of diverging flange members and the fourth pair of guide rib members that is equal to the thickness of a form panel.

Still another embodiment of the invention contemplates a clip for holding rebar in place protruding perpendicularly outward from the first section of the elongated member in a coplanar configuration with the elongated member at a point intermediate the first and second pairs of diverging flange members. A second clip for holding rebar in place similarly protrudes perpendicularly outward from the second section of the elongated member. A plurality of clips for holding rebar may be used.

Yet another embodiment of the invention contemplates a void or a plurality of voids formed in the elongated member through which concrete can flow.

The invention can be fabricated from a variety of plastic materials, a lightweight metal, or other suitable material.

DETAILED DESCRIPTION OF THE PREFERRED EMBODIMENTS

Figure 1:
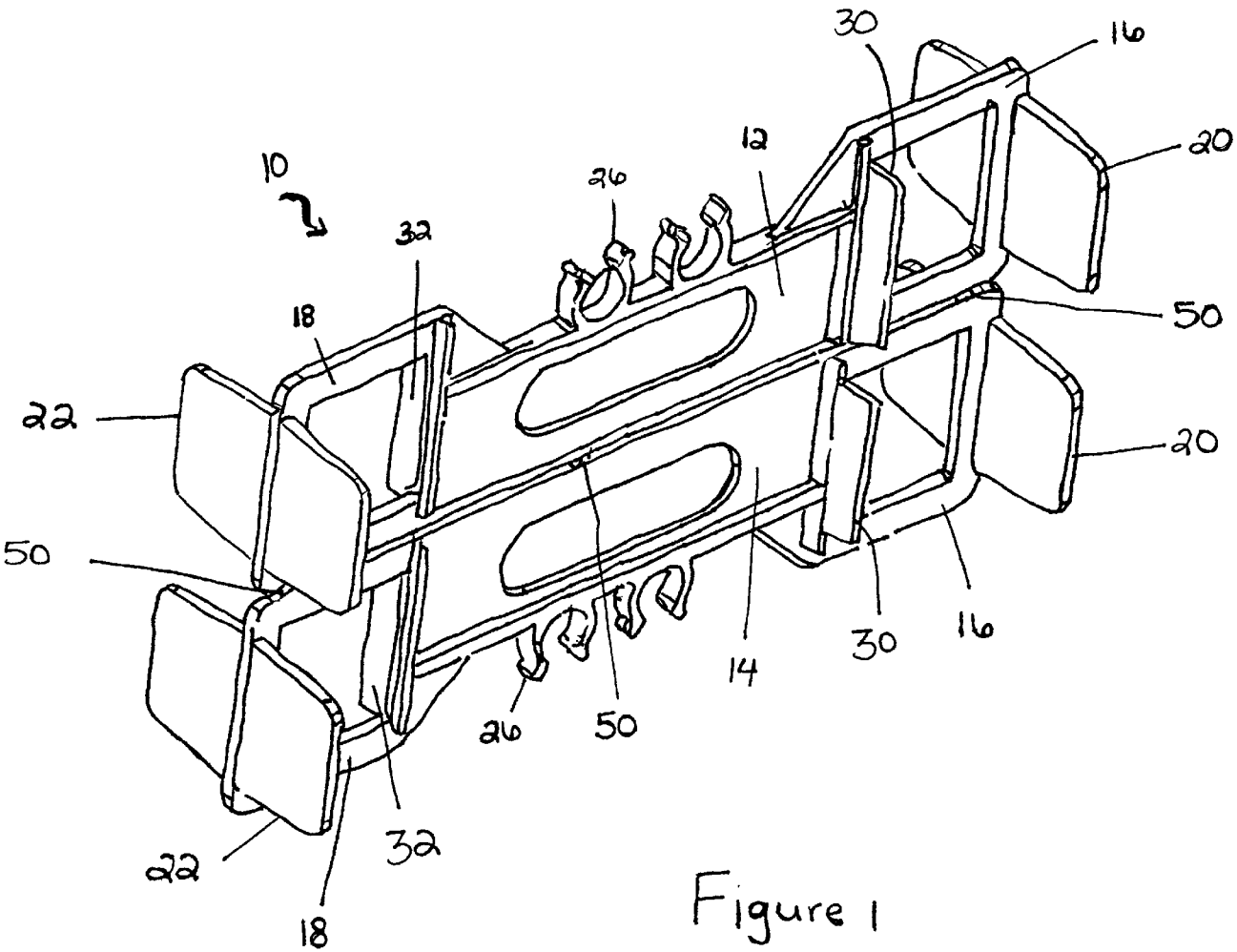
FIG. 1 is a planar view of the inventive tie having two pairs of guide ribs, a plurality of clips for holding cement reinforcing metal bars or "rebar" in place, with provision for separating the top half of the tie from the bottom half.

Referring to FIG. 1, a tie 10 constructed in accordance with the present invention is illustrated. Tie 10 is constructed out of a flexible polymer, a plastic, or a lightweight metal such as aluminum. In accordance with the preferred embodiment of the invention, tie 10 is injection molded from a tough resilient plastic, such as polystyrene.

Tie 10 is comprises a first upper section 12 and a second lower section 14. First section 12 and second section 14 have first ends 16 and second ends 18. First section 12 and second section 14 are joined by narrow frangible bridges 50. Frangible bridges 50 can be broken or cut allowing first section 12 to be separated from second section 14.

Figure 2:
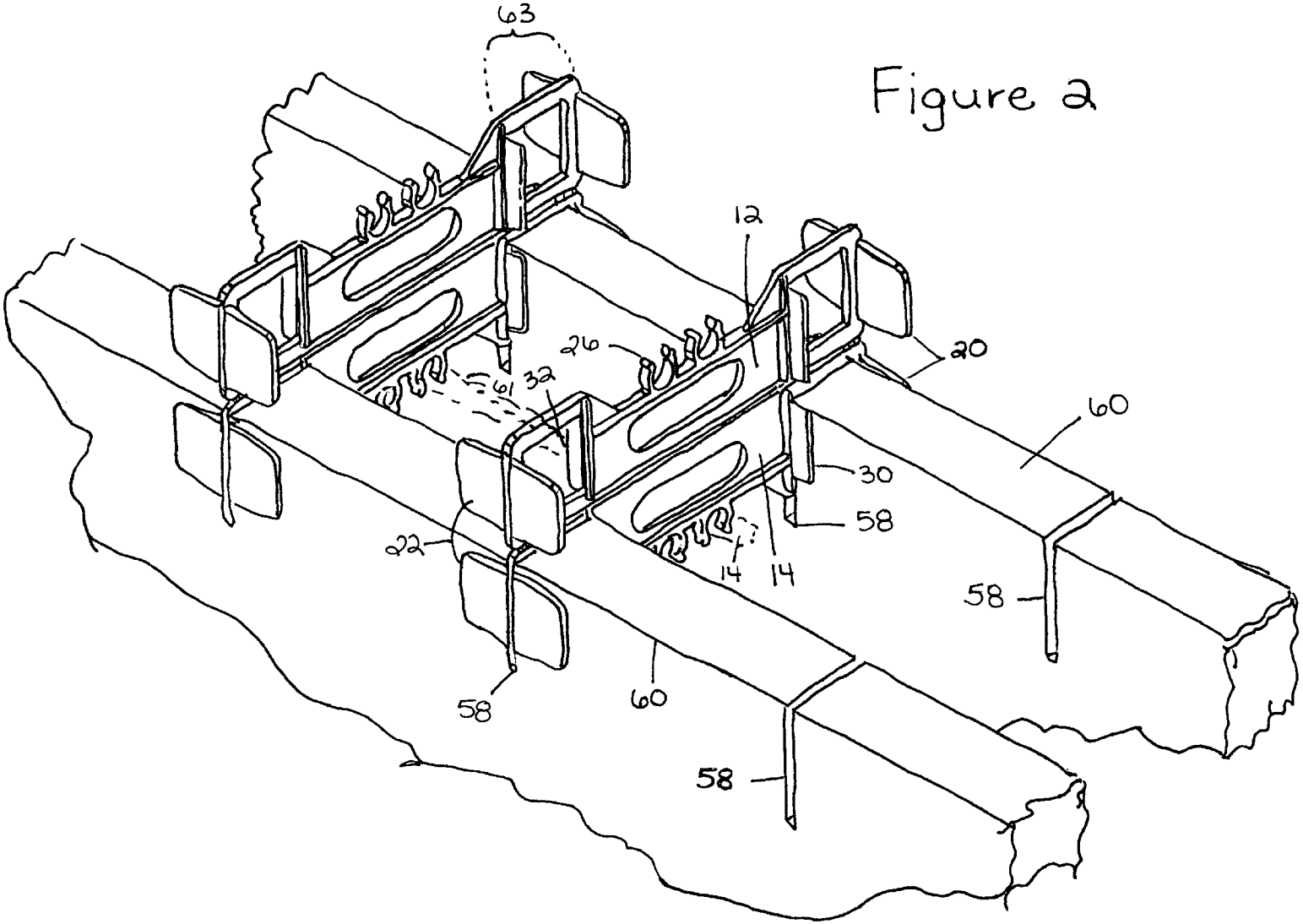
FIG. 2 is a planar view of the tie system showing two ties as they are positioned between form panels prior to the pouring of concrete into the form.

Generally, ties 10 are placed and may be used to form a form for pouring cement, as illustrated in FIG. 2. As can be seen in the figure, a form is formed by a pair of spaced and facing panels 60 (usually made of expanded modified polystyrene. During use, concrete reinforcing bars 61 are placed in clips 26 in the ties 10, and concrete is poured between the panels 60. After the concrete hardens, the form panels 60 may be removed, leaving behind a concrete wall. Alternately, form panels 60 may be left on the concrete wall to serve as insulation or a base for another type of finish. If the form panels 60 are removed, protruding portions 63 of ties 10 can be broken off and removed before finishing the concrete wall.

Figure 3:
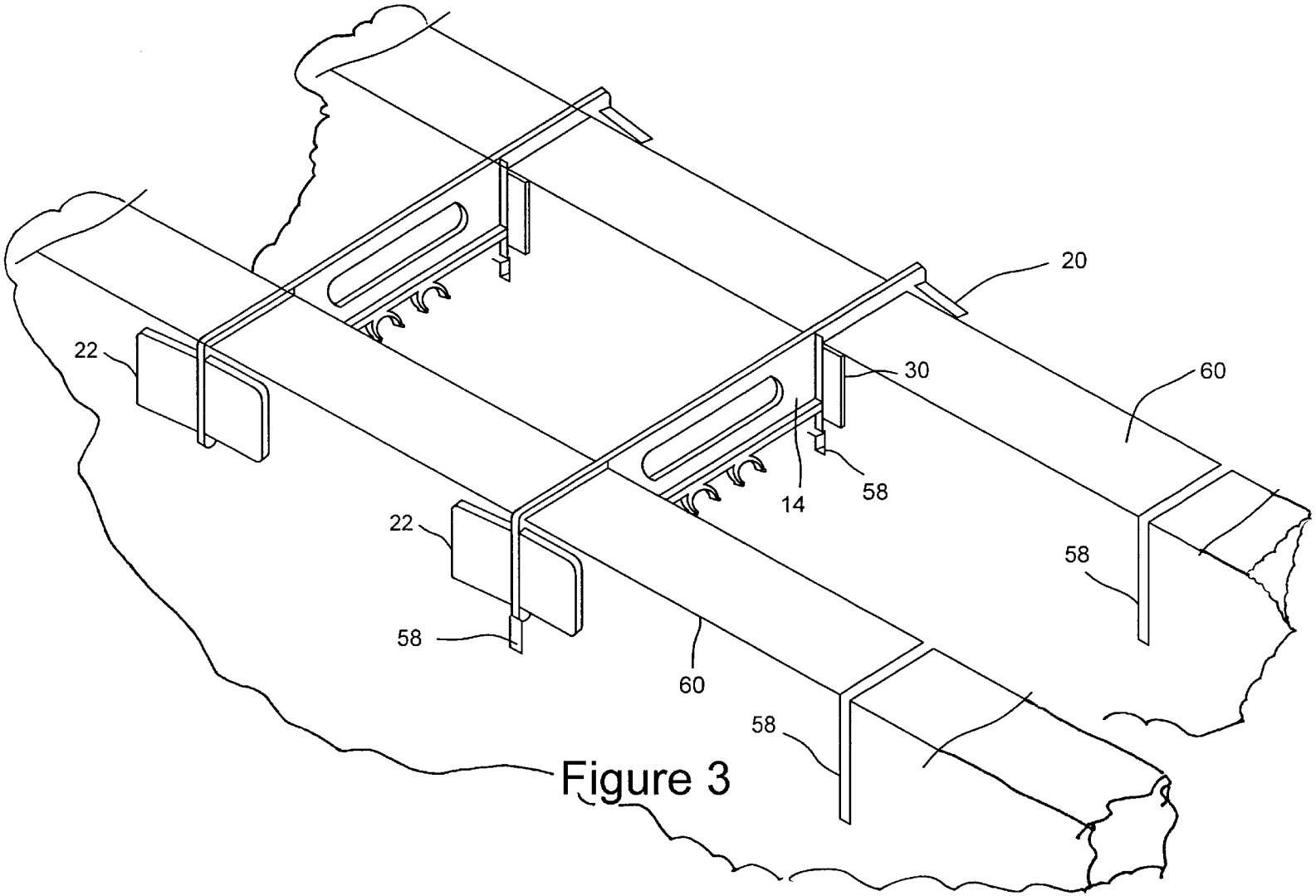
FIG. 3 is a planar view of the tie system showing two ties as they are positioned between form panels and at the top edge of the form panels prior to the pouring of concrete into the form.

As can be understood from FIG. 3, in addition, in accordance with the preferred embodiment, a particularly advantageous mode of use is achieved with respect to the bottom and top of the mold. In particular, first section 12 of second section 14 can be inserted into a top or bottom transverse slot 58 of form panel 60 in such a manner so as to not protrude above the top or below the bottom edge of form panel 60. Such an arrangement showing the use of a half-tie at the top of a mold is illustrated in FIG. 3.

First sections 12 and second sections 14 are configured to receive, support, and maintain in a spaced configuration a pair of form boards 60. On the first ends 16 of both first section 12 and second section 14 are disposed a first pair of diverging flange members 20. Diverging flange members 20 are positioned, configured, and dimensioned to project perpendicularly outward from the planes of first section 12 and second section 14. A second pair of diverging flange members 22 are disposed on the second ends 18 of both first section 12 and second section 14 and project similarly outward from the planes of first section 12 and second section 14. Diverging flange members 20 and 22 provide better support to form panels 60 against the stresses incurred by the pouring of wet concrete.

First ends 16 of first section 12 and second section 14 have disposed on them a first pair of guide rib members 30 at points distal from the diverging flange members 20. The distance between the first pair of guide rib members 30 and diverging flange members 20 defines the thickness of form panel 60. Guide rib members 30 perpendicularly protrude from one side of first section 12 and second section 14 outward and in such a manner so as to be in a parallel planar relationship with diverging flange members 20.

Second ends 18 of first section 12 and second section 14 have disposed on them a second pair of guide rib members 32 at points distal from the diverging flange members 22. The distance between the second pair of guide rib members 32 and diverging flange members 22 also defines the thickness of form panel 60. Second pair of guide rib members 32 protrudes from the opposite side from which first pair of guide rib members 30 protrude. Second pair of guide rib members 32 protrudes from first section 12 and second section 14, perpendicularly outward and in such a manner so as to be in a parallel planar relationship with diverging flange members 22.

Clips 26 for holding rebar in place protrude from the top edge of first section 12 and bottom edge of second section 14. Clips 26 are molded as part of both first section 12 and second section 14 if tie 10 is plastic. Alternately, clips 26 are cast as part of both first section 12 and second section 14 if tie 10 is made of metal. Clips 26 consistent of two curved prongs which protrude away from the first section 12 and second section 14 in an arcing fashion. The arcing prongs are situated and configured in such a manner that the concave portions of each arcing prong face each other. Furthermore, the arcing prongs conform substantially to the radius of the cross section of the rebar. Arcing prongs are constructed so as to be flexible. The prongs can be spread apart when rebar is forced part way between them and can clip around and hold rebar firmly when the rebar is forced all the way between them. A plurality of clips 26 can be molded or cast into each first section 12 and second section 14.

FIG. 2 is a planar view of two ties 10 inserted into slots 58 in two form panels. Ties 10 are positioned in a row of slots 58 evenly spaced in the top and bottom edges of form panels 60 on one side and in a corresponding row of equally spaced slots 58 in form panels 60 on the opposite side. Form panels 60 are typically constructed of polystyrene or a similar deformable material, which may be left on one or both sides of the formed wall as insulation. Alternately, form panels 60 may also be constructed of wood. It is contemplated that in the case of form panels 60 made of wood, the panels 60 may be reused.

Figure 4:
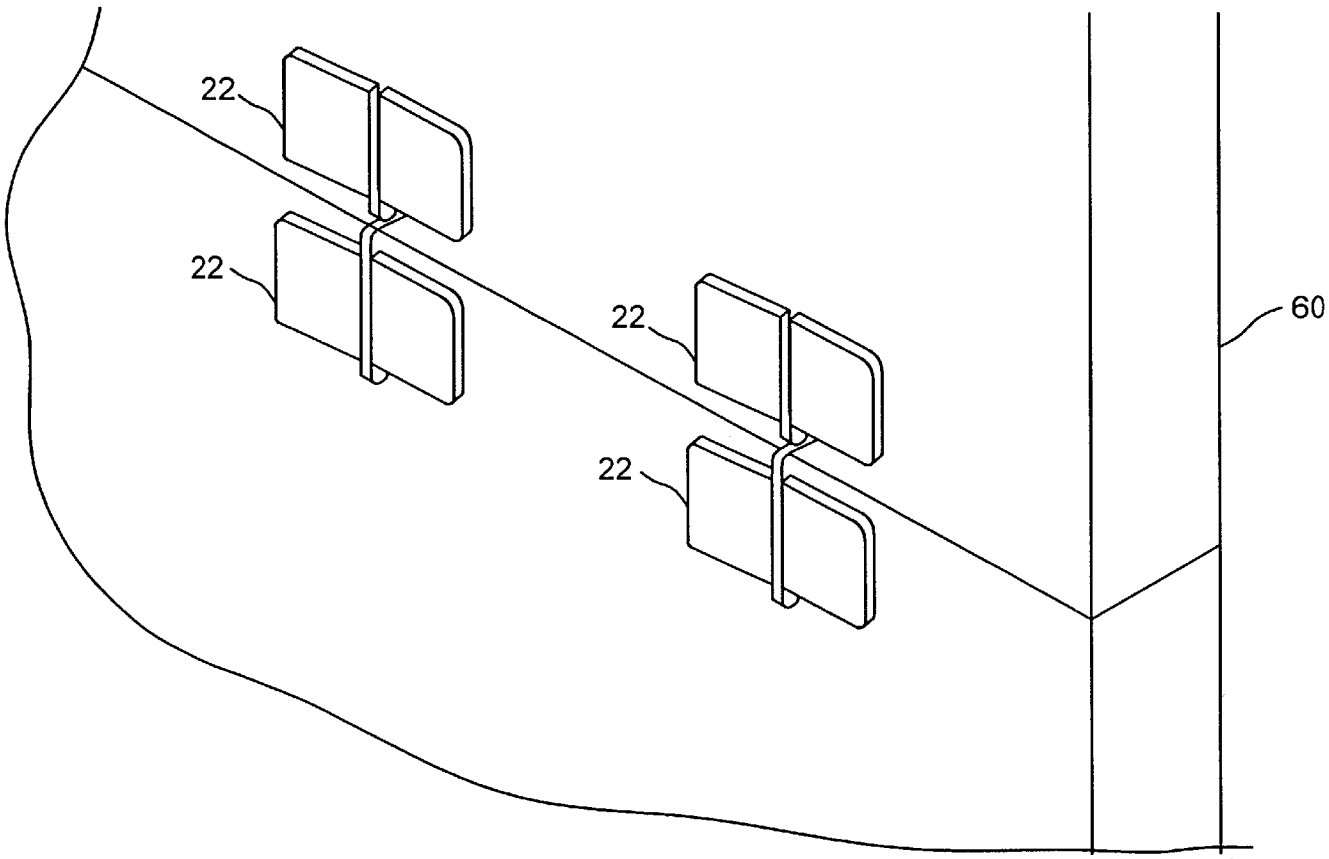
FIG. 4 is a planar view of the tie system showing two ties at the interface of two form panels.

The height of the ties 10 is approximately twice the depth of the slots 58 of form panels 60, so that half of each of the ties fits into a slot 58 in the form panel 60 below while the other half fits into a slot 58 in the form panel 60 above, thereby causing ties 10 to straddle the interfaces between horizontal edges of upper and lower form panels 60, as illustrated in FIG. 4.

Figure 5:
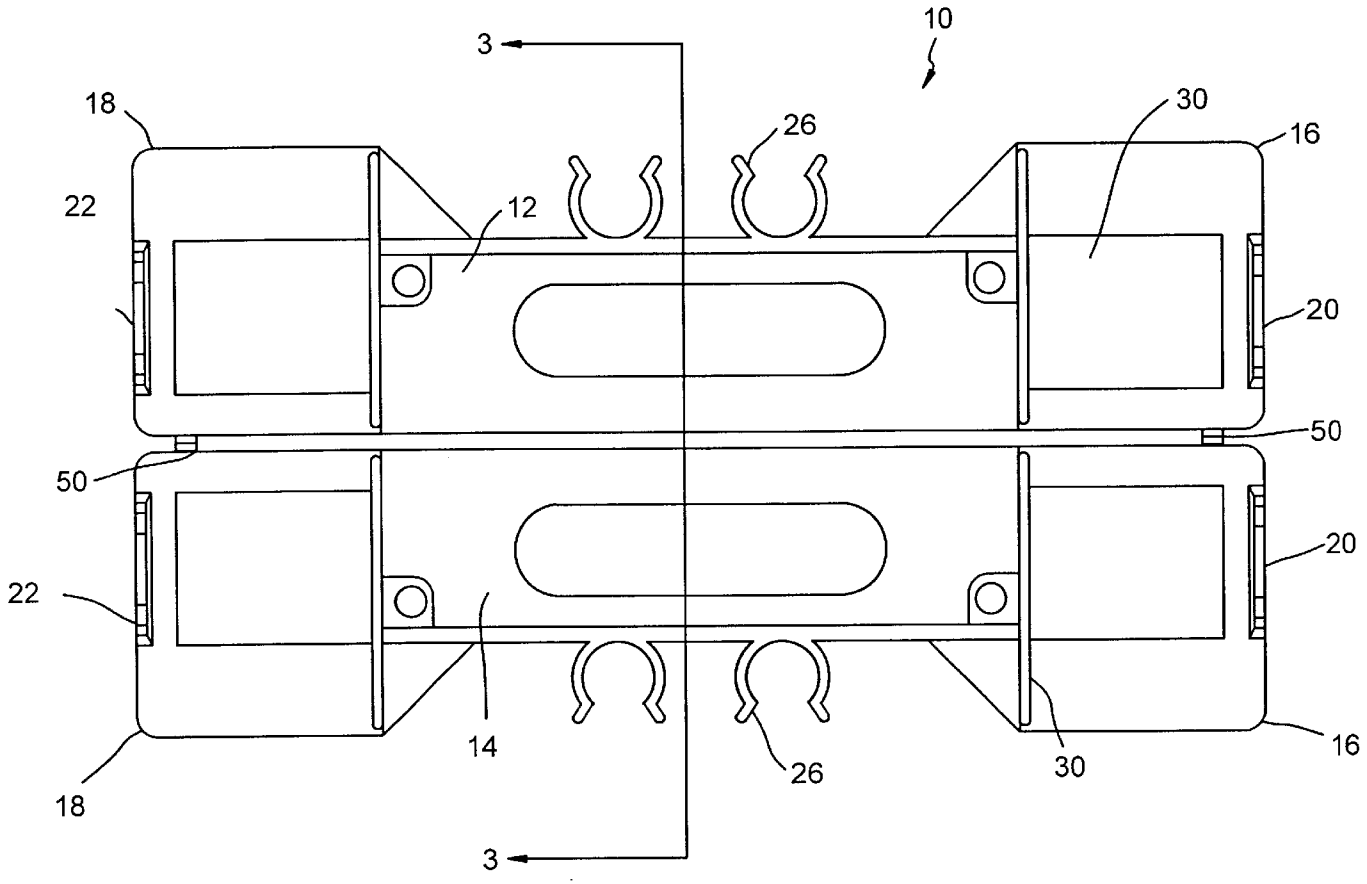
FIG. 5 is a side view of the tie showing two pairs of guide ribs, a plurality of clips for holding rebar in place.

Second section 14 is inserted into the slots 58 of form panels in such a manner so as one form panel is held between diverging flange member 20 and guide rib 30 on second section 14 of tie 10. Likewise, another form panel is held between diverging flange member 22 and guide rib 32 on second section 14 of tie 10. Once two form panels 60 are adequately linked together at their tops using a number of ties 10 that correspond to the number of slots 58 in the forms panels 60, additional form panels 60 may be placed on top of the linked form panels 60 and held together by the first sections 12 of ties 10. In this manner, the form panels can be stacked to a height that meets the specification of the concrete wall to be built FIG. 5 is a side view of tie 10. Separating the first section 12 from the second section 14 in order to use half of the tie 10 at the top or bottom of a form panel involves cutting frangible bridges 50.

Figure 6:
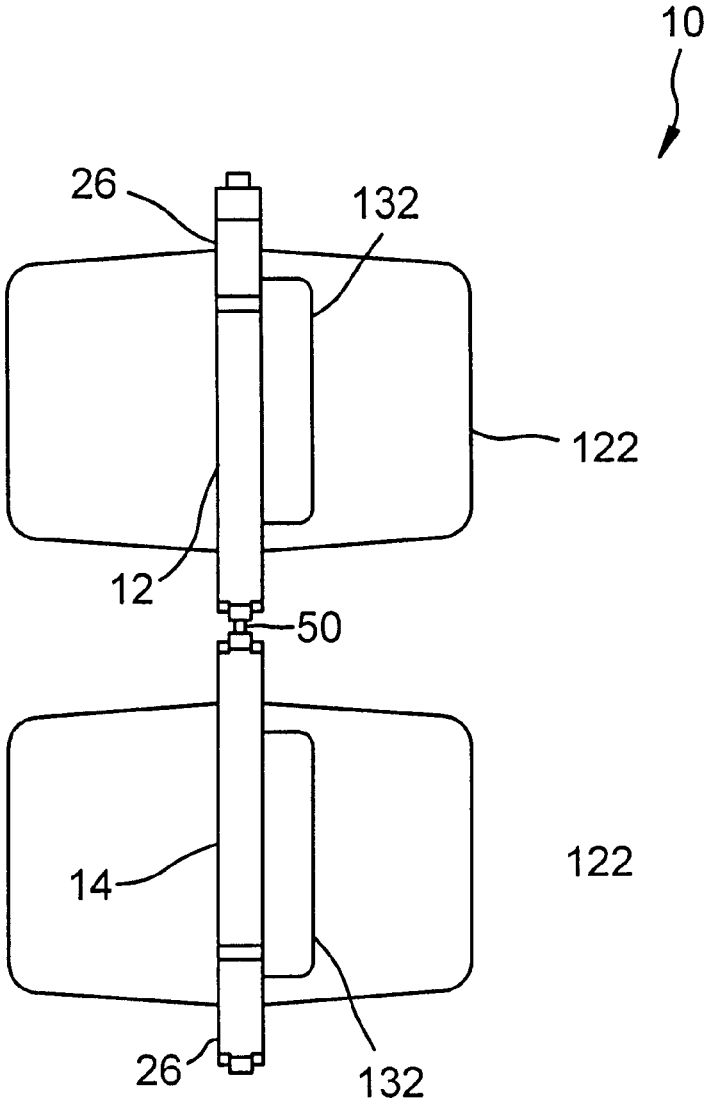
FIG. 6 is an end view of the tie along line 3—3 of FIG. 5.

FIG. 6 shows an end view illustration of tie 10 along the line 3-3 of FIG. 5. Second pair of guide rib members 32 is shown on the second end of tie 10. Frangible bridge 50 is also illustrated.

In FIG. 1, only two pairs of guide rib members are shown. Each are located on opposing sides of tie 10. However, referring now to FIG. 7, another embodiment of the tie is disclosed. Tie 110 has two additional pairs of guide rib members attached to first section 112 and second section 114 of tie 110. A third pair of guide rib members 134 is disposed on the first end of tie 110 at points distal from diverging flange members 120 and opposite the first pair of guide rib members 130.

Third pair of guide rib members 134 protrudes from first section 112 and second section 114 perpendicularly outward from the plane of tie 110 and in the opposite direction from first pair of guide rib members 130. In a similar manner fourth pair of guide rib members 136 is situated on the second end of tie 110 distal from diverging flange member 122 and protrudes perpendicularly outward from the plane of tie 110 and in the opposite direction from second pair of guide rib members 132.

The distance between the first pair of guide rib members 130 and diverging flange member 120, as well as the distance between third pair of guide rib members 134 and diverging flange member 120, defines the thickness of a form panel situated on the first end 116 of tie 110 and placed so as to form one side of a wall. Likewise, the distance between the second pair of guide rib members 132 and diverging flange member 122, as well as the distance between fourth pair of guide rib members 136 and diverging flange member 122, defines the thickness of a form panel situated on the second end 118 of tie 110 and forms the second side of a wall. The volume defined between the two form panels, which is partially occupied by the tie 110, is where concrete is poured to form the wall.

Figure 7:
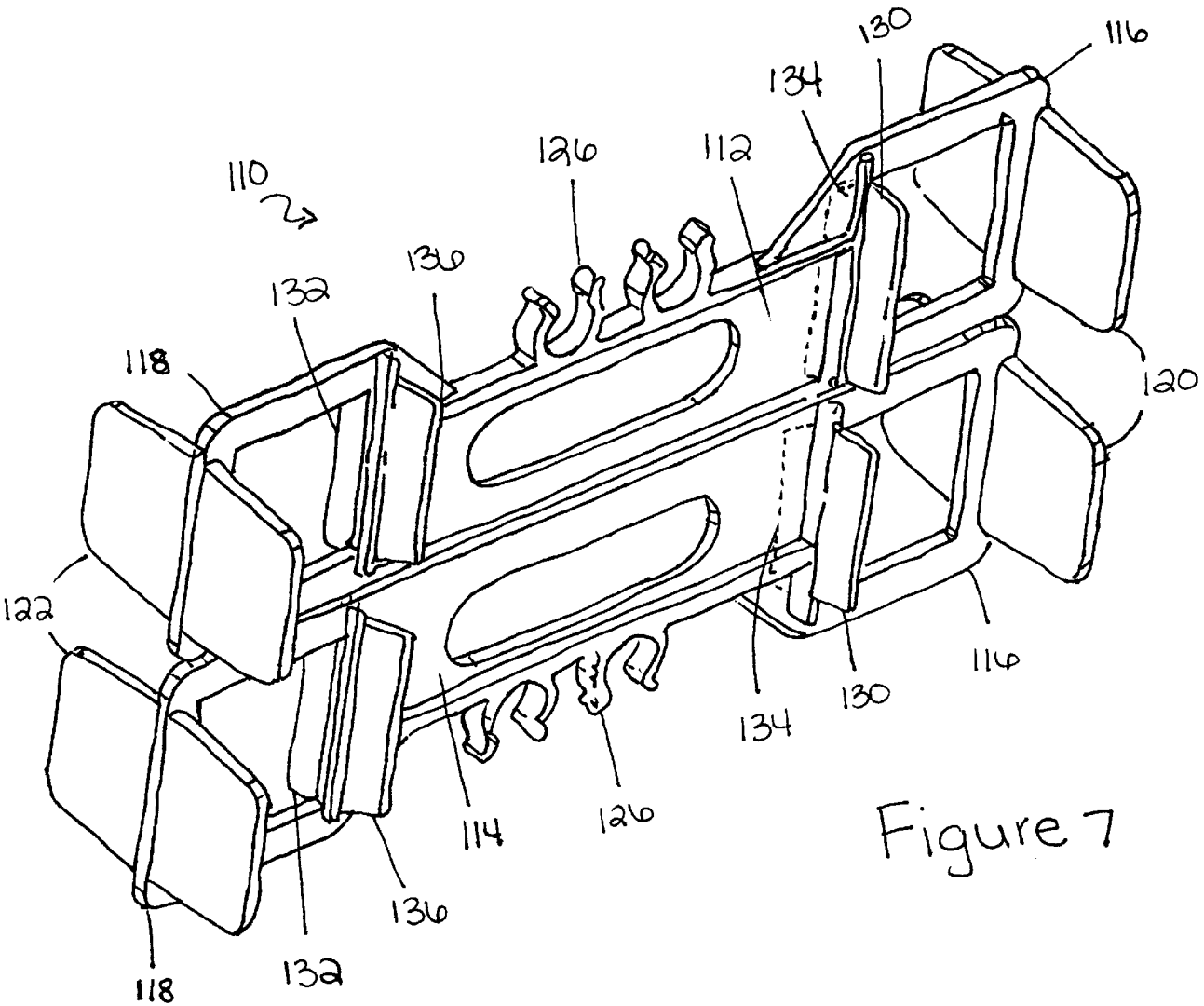
FIG. 7 is a planar view of the tie showing four pairs of guide ribs and a plurality of clips for holding rebar in place.
Figure 8:
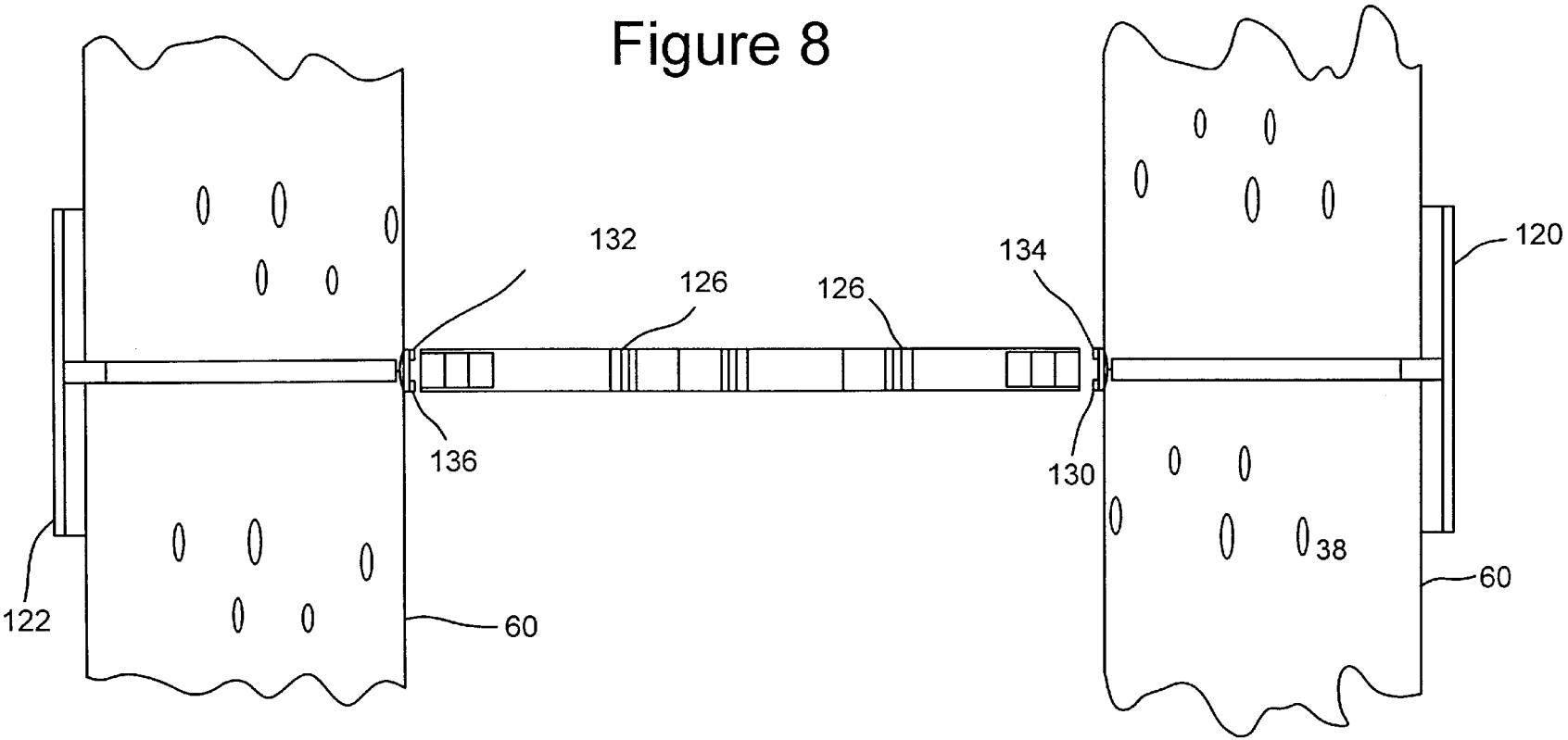
FIG. 8 is a top view of a tie having four pairs of guide ribs as it would be employed in a form panel system.

FIG. 8is an illustration of the top view of tie 110 of FIG. 7 as it would be employed in a wall form system. Guide ribs 130 and 134 serve to hold form panel 60 against diverging flange members 120, while guide ribs 132 and 136 serve to hold form panel 20 against diverging flange members 122.

While two illustrative embodiments of the invention have been described above, it is understood that various modifications may be made without departing from the spirit and scope of the invention, which is limited and defined only by the appended claims.

What is claimed is:

1. A tie for interlocking form panels comprising:

(a) an elongated member being substantially planar and having a first section and a second section, said elongated member having a first side and a second side, and said first section having a first end and a second end and said second section having a third end and a fourth end, said first and third ends being adjacent to each other and said second and fourth ends being adjacent to each other on said elongated member;

(b) a first pair and a second pair of flange members diverging from said elongated member at said first and said second ends respectively of said first section of said elongated member, said flange members having substantially planar panel-engaging surfaces and extending transversely out of the plane of said elongated member from said first side of said elongated member and said second side of said elongated member respectively;

(c) a third pair and a fourth pair of flange members diverging from said elongated member at said third and said fourth ends respectively of said second section of said elongated member, said flange members having substantially planar panel-engaging surfaces and extending transversely out of the plane of said elongated member from said first side of said elongated member and said second side of said elongated member respectively;

(d) a first pair of guide rib members diverging from said first side on said first and second sections respectively of said elongated member, said first pair of guide rib members having substantially planar panel-engaging surfaces and extending transversely out of the plane of said elongated member at points equally distant from the flange members of said first and third pairs of flange members extending transversely out of the plane of said elongated member from said first side so as to define an opening between the flange members of said first and third pairs of flange members extending transversely out of the plane of said elongated member from said first side and said first pair of guide rib members into which a form panel may be inserted;

(e) a second pair of guide rib members diverging from said second side on said first and second sections respectively of said elongated member, said second pair of guide rib members having substantially planar panel-engaging surfaces and extending transversely out of the plane of said elongated member at points equally distant from the flange members of said second and fourth pairs of flange members extending transversely out of the plane of said elongated member from said second side so as to define an opening between the flange members of said second and fourth pairs of flange members extending transversely out of the plane of said elongated member from said second side and said second pair of guide rib members into which a form panel may be inserted; and (f) at least one frangible bridge permitting separation of said elongated member into said first section and said second section.

2. The tie of claim 1, further comprising:

(g) a third pair of guide rib members diverging from said first side on said first and second sections respectively of said elongated member, said third pair of guide rib members having substantially planar panel-engaging surfaces and extending transversely out of the plane of said elongated member at points equally distant from the flange members of said second and fourth pairs of flange members extending transversely out of the plane of said elongated member from said first side so as to define an opening between the flange members of said second and fourth pairs of flange members extending transversely out of the plane of said elongated member from said first side and said third pair of guide rib members into which a form panel may be inserted; and, (h) a fourth pair of guide rib members diverging from said second side on said first and second sections respectively of said elongated member, said fourth pair of guide rib members having substantially planar panel-engaging surfaces and extending transversely out of the plane of said elongated member at points equally distant from the flange members of said first and third pairs of flange members extending transversely out of the plane of said elongated member from said second side so as to define an opening between the flange members of said first and third pairs of flange members extending transversely out of the plane of said elongated member from said second side and said fourth pair of guide rib members into which a form panel may be inserted.

3. The tie of claim 1, wherein a first means for holding rebar in place extends from said first section of said elongated member in a coplanar configuration with said elongated member at a point intermediate said first pair and said second pair of flange members and a second means for holding rebar in place extends from said second section of said elongated member in a coplanar configuration with said elongated member at a point intermediate said third pair and said fourth pair of flange members.

4. The tie of claim 3, wherein a plurality of means for holding rebar in place extend from said first section of said elongated member at points intermediate said first pair and said second pair of flange members and said second section of said elongated member at points intermediate said third pair and said fourth pair of flange members.

5. The tie of claim 1, wherein said elongated member defines a void through which concrete can flow.

6. The tie of claim 5 wherein said elongated member defines a plurality of voids through which concrete can flow.

7. The tie of claim 1 wherein said tie is fabricated from high density plastic.

8. The tie of claim 1 wherein said tie is fabricated from lightweight metal.

9. A form tie for a concrete wall forming system, the concrete forming system including at least one pair of panels intended to be maintained in an upright position and held in a mutually spaced apart relationship by one or more of said form ties, the panels each having inner and outer faces and upper, lower and side edges in said upright position, whereby concrete can be poured between the panels to form the concrete wall, the form tie comprising an elongated member having:

a) two longitudinal sections, each section having:

i) first and second member ends; and ii) at each member end, a pair of panel-engaging members to grip and position the panels, the panel-engaging members of one pair being respectively engageable with the inner and outer faces of one of the panels and the panel-engaging members of the other pair being respectively engageable with the inner and outer faces of the other of the panels; and b) a frangible bridge connecting the longitudinal sections; wherein one of the longitudinal sections can be engaged with the pair of panels and the other longitudinal section can be separated from the engaged section by breaking the frangible bridge.

10. A form tie for a concrete wall forming system as in claim 9, further comprising a plurality of frangible bridges connecting the longitudinal sections.

11. A form tie for a concrete wall forming system as in claim 9, wherein the form panels have slots for receiving said longitudinal sections therein.

12. A form tie for a concrete wall forming system as in claim 9, wherein said form panels comprise a lightweight insulation material.

* * * * *